United States Patent [19]

Cohen

[11] Patent Number: 4,821,889

[45] Date of Patent: Apr. 18, 1989

[54] DISPLAY STAND FOR ADVERTISING DISTANCE MEASURING DEVICES

[75] Inventor: Herbert Cohen, Rosslyn Heights, N.Y.

[73] Assignee: Sonin, Inc., Scarsdale, N.Y.

[21] Appl. No.: 186,407

[22] Filed: Apr. 26, 1988

[51] Int. Cl.[4] ..... A47F 7/00

[52] U.S. Cl. ..... 211/13; 248/455

[58] Field of Search ..... 211/13, 85, 71, 72; 248/542, 460, 455, 450, 447; 40/1, 358

[56] References Cited

U.S. PATENT DOCUMENTS

| | | | |
|---|---|---|---|
| 694,446 | 7/1888 | Towle | 248/450 |
| 1,652,774 | 12/1927 | Fraser et al. | 248/542 X |
| 1,850,616 | 3/1932 | Barnett | 248/542 X |
| 2,089,595 | 8/1937 | Bourne | 248/460 |
| 3,897,037 | 7/1975 | Johnson et al. | 248/460 |
| 3,977,521 | 8/1976 | Murphy | 211/13 X |
| 4,181,282 | 1/1980 | Oliver et al. | 248/455 X |

*Primary Examiner*—J. Franklin Foss
*Assistant Examiner*—Sarah A. Lechok Eley
*Attorney, Agent, or Firm*—Pollock, Vande Sande & Priddy

[57] ABSTRACT

A display stand for demonstrating a distance measuring device. A planar surface having a front side supports the distance measuring device between two integral flanges. The flanges terminate at opposite ends of the planar surface. A supporting leg supports the stand in a sufficiently vertical position to permit viewing of the planar surface and the distance measuring device. A measuring indicia disposed on the front side displays the distance between said flanges when a customer initiates a measurement on the display device.

4 Claims, 1 Drawing Sheet

DISPLAY STAND FOR ADVERTISING DISTANCE MEASURING DEVICES

BACKGROUND OF THE INVENTION

The present invention relates in general to point of sale advertising devices. Specifically, a display stand is described which will permit the display and operation of distance measuring devices so that potential customers may observe the operation and measurement results produced by these devices before purchase.

Ultrasonic measuring devices for accurately measuring room dimensions are currently being sold by SONIN, Inc. which will accurately measure to within ¼ inch the distance between a reference surface and an object located up to 60 feet away. These devices are electronic, are compact and of a size to fit in a person's pocket or toolbox. A typical retail establishment for making sales of these distance measurement devices include a local hardware store or other convenience store.

In order to successfully demonstrate the use and operation of these devices, customers prefer to see the device in operation. Once the capabilities of the distance measuring devices are demonstrated, including the simplicity of operation and the very substantial accuracy in measurement, customers are more apt to purchase such a device.

The typical retail establishment for selling these distance measurement devices in general have a limited amount of shelf space and other space for displaying such a unit. Further, as these units retail for a relatively small purchase price, and are sold in many hundreds and potentially thousands of retail establishments, there is an obvious need to minimize the shelf space, the cost of display and handling of these devices.

With the foregoing requirements in mind, the present invention has been developed.

SUMMARY OF THE INVENTION

It is an object of this invention to display and advertise distance measurement devices.

It is a more specific object of this invention to display distance measuring devices in a manner which will permit a customer to operate and observe the result of making a distance measurement.

These and other objects are provided by a display stand which supports the distance measuring device so that potential customers can operate the measuring device and actually observe the result. The test stand takes a minimum of shelf space, and is collapsible to a package size suitable for mailing to retailers.

The test stand is supported in a sufficiently vertical position to permit observation of the distance measuring device, as well as various sales information relating to the device. The distance measuring device is fully operational and measures between two precise flanges located on the test stand.

One end of the distance measuring device which serves as a measurement reference is supported against one flange on the test stand connecting the two flanges. The back of the device rests on the surface of the test stand. The end of the measuring device, which emits and receives acoustic energy, faces the second opposite flange on the display stand. Customers approaching the display stand can operate the distance measuring device and observe the measured distance between flanges. Adjacent to the distance measuring device is a ruler or other measurement indicia, showing the actual distance between flanges on the test stand. Thus, the customer can readily observe the correspondence between the ruler and the displayed distance measurement.

In a preferred embodiment of the invention, a compartment open at the top is located adjacent the distance measuring device. This compartment is used to store point of sale literature which the customer may take with him after seeing the unit in operation.

DESCRIPTION OF THE PREFERRED EMBODIMENT

Figure 1:
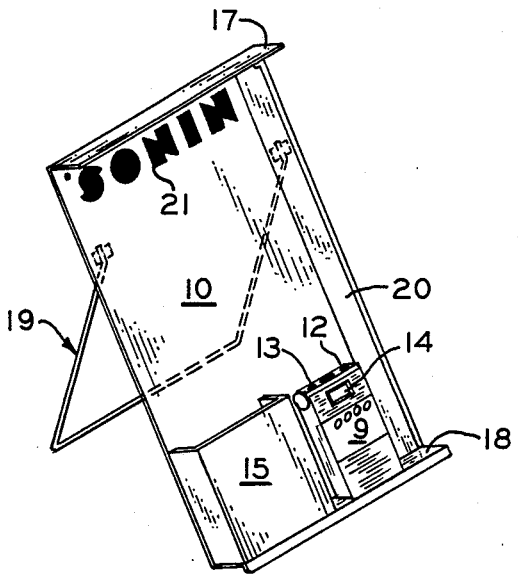
FIG. 1 is a perspective view of the display stand in accordance with one embodiment of the invention.
Figure 2:
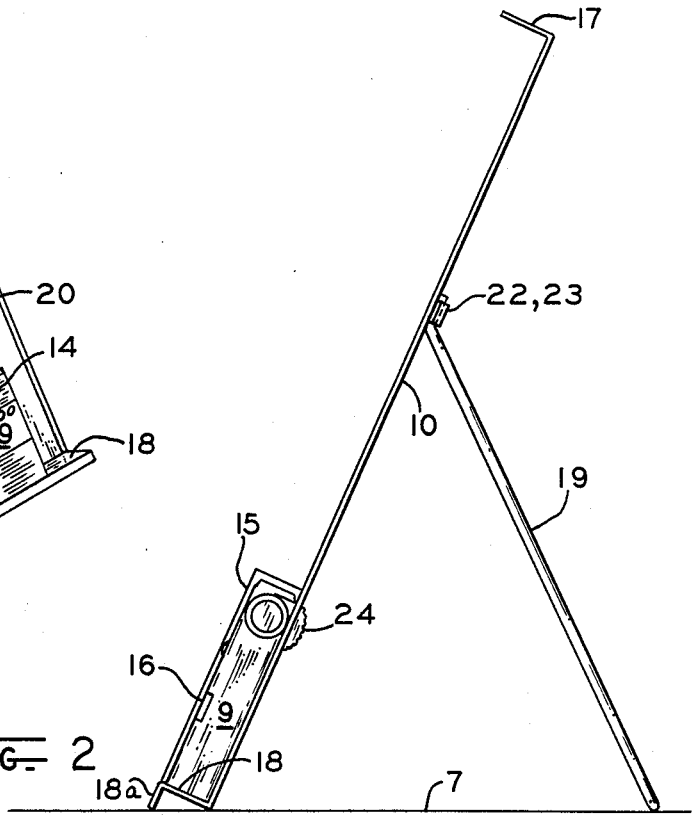
FIG. 2 is a side view of the test stand in its operating position.

Referring now to the drawing Figures, particularly FIGS. 1 and 2, there is shown a test stand 10 of a preferred embodiment in its actual display environment. A table surface or shelf surface 7 supports the test stand 10 in a sufficiently vertical position so that any advertising message printed on the face of the test stand 10 will be observed by a user. The test stand 10 has flanges 17 and 18 at opposite ends thereof. Flange 18 includes yet another smaller flange **18*a* which assists in supporting the test stand in combination with a supporting leg 19 for view by a potential customer. The test stand 10 includes first and second supports 22 and 23 for retaining ends of the leg 19**.

The distance measuring device 9 includes two ultrasonic transducers 12 and 13 at one end thereof. In the SONIN-60 measurement device, the transducers 12 and 13 emit acoustic energy along an axis perpendicular to either flange 17 or 18. The acoustic energy is reflected from flange 17 and is received back through the receive transducer 13 of the measuring device 9. The actual measured distance is displayed on an LED display 14. The leg 19 and main stand 10 are separable, permitting easy shipping and storage of the test stand.

Figure 3:
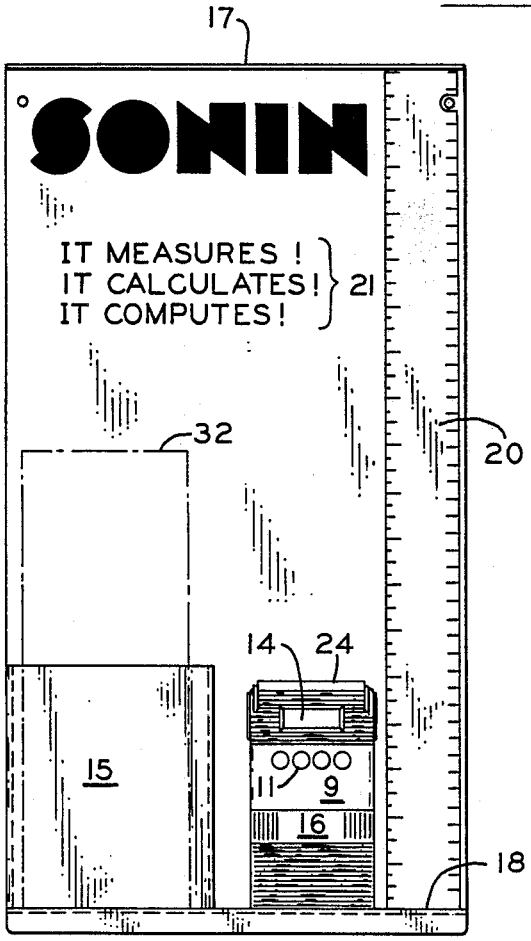
FIG. 3 is a front view of the test stand 10.
Figure 4:
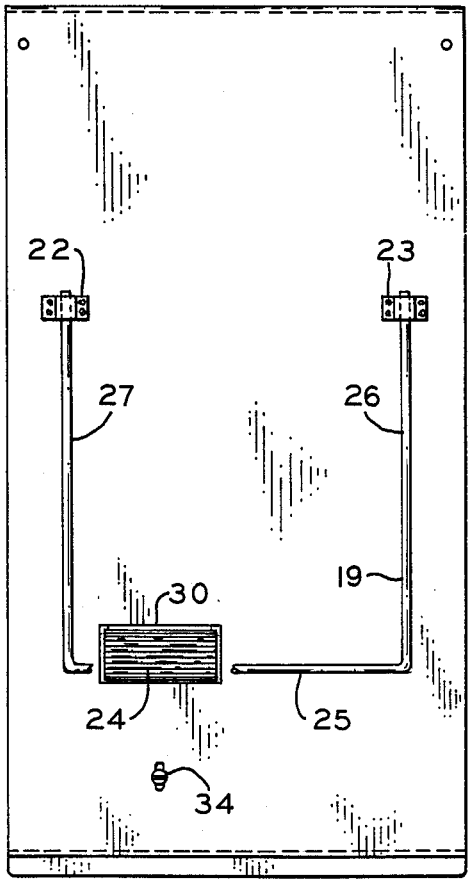
FIG. 4 is a rear view of the test stand 10.

Adjacent one side of the measuring device 9 is a container 15 open at the top thereof to receive any advertising literature 32 which the retailer may wish to supply to his customers. Adjacent another side of the measuring device 9 there is a ruler 20 which illustrates the actual distance between flanges 17 and 18. A customer will see the view shown in FIG. 3, including the ruler 20, device 9 and any advertising message 21 which the retailer or OEM supplies. In the case of the SONIN-60 measuring device, a measuring bar 16 is used to begin the measurement. Thus, customers in the retail establishment can approach the test stand, depress the measuring bar 16 and display the actual distance between flanges 17 and 18. It is recognized that the usual frame of reference is the edge of the measuring device 9 opposite the ultrasonic transducers 12 and 13, abutting flange 18. Any customer visiting the retail establishment will quickly see how the unit works, observe its extraordinary accuracy and also be provided with any sales literature 32 which can be reviewed at a later time.

The distance measuring device 9, in accordance with the SONIN design, includes a movable hood 24 which can be moved from a position covering the transducers 12 and 13, which disables the battery power in the unit 9 to an operating position 90° away, exposing the transducers 12 and 13. A rectangular slot 30 is cut in the display stand 10 surface which is usually sheet metal, permitting the cover 24 to be received through the test stand 10. Thus, the rear surface of the distance measuring device 9 is supported so that it is flush with the front surface of the display stand 10. A small mounting screw 34 is shown which conveniently engages the threaded boss on the measuring device 9 through a hole.

The legs 19 are shown as including two sufficiently vertically extending segments 26 and 27, engaged in the retaining clips 22 and 23. The ends of these segments are connected by a horizontal section 25 normally resides on the surface 7 supporting the test stand. Thus, the retailer can store, unpack and display the test stand easily, and the stored configuration provides for minimum packaging and transportation costs.

Thus, it is clear that the embodiment described provides for display and advertising of distance measuring devices in a way which will demonstrate its operation, without taking unnecessary shelf space. The features of the invention can clearly be advertised and its performance observed in a manner to enhance the sale of the devices.

The foregoing embodiment is but one example of the invention as described in the claims which follow.

What is claimed is:

1. A display stand for demonstrating a distance measuring device of the type which emits an acoustic wave and receives a reflection from a distant surface comprising:

a planar surface having a front side for supporting a rear surface of said distance measuring device between two integral fixed flanges which terminate opposite vertically disposed ends of said planar surface, said distance measuring device having one end abutting one of said flanges, and an opposite acoustic wave emitting and receiving end facing the remaining of said flanges, said measuring device being operable to measure the distance between said fixed flanges and display said measured distance;

a supporting leg connected to a rear side of said planar surface supporting said surface in a sufficiently vertical position to permit viewing of said planar surface front side; and a measuring indicia disposed on said front side adjacent said distance measuring distance which displays the fixed distance between said flanges which can be visually observed and compared to a measured distance displayed on said distance measuring device; and a rectangular enclosure supported on said planar surface open at one end for supporting sales literature adjacent said distance measuring device.

2. The display stand of claim 1 wherein said front side of said planar surface displays advertising indicia.

3. The display stand of claim 1 wherein said supporting leg is detachably connected to said planar surface.

4. The display stand of claim 1 wherein said supporting leg comprises a horizontal section connected at each end to first and second support sections perpendicular to said horizontal section ends, said support sections being retained in first and second retaining clips connected to said planar surface rear side.

* * * * *